US010494794B2

(12) United States Patent
Kunz

(10) Patent No.: US 10,494,794 B2
(45) Date of Patent: Dec. 3, 2019

(54) EDGE PROTECTION SYSTEM FOR AN IMPLEMENT

(71) Applicant: Caterpillar Inc., Peoria, IL (US)

(72) Inventor: Phillip John Kunz, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 29 days.

(21) Appl. No.: 15/622,997

(22) Filed: Jun. 14, 2017

(65) Prior Publication Data

US 2018/0363275 A1 Dec. 20, 2018

(51) Int. Cl.
*E02F 9/28* (2006.01)
*E02F 3/40* (2006.01)

(52) U.S. Cl.
CPC ..... *E02F 9/2883* (2013.01); *E02F 9/2833* (2013.01); *E02F 9/2841* (2013.01); *E02F 9/2891* (2013.01); *E02F 3/40* (2013.01)

(58) Field of Classification Search
CPC ..... E02F 9/2816; E02F 9/2825; E02F 9/2833
USPC ..... 37/452, 453, 455
See application file for complete search history.

(56) References Cited

U.S. PATENT DOCUMENTS 4,187,035 A * 2/1980 Colburn ..... E02F 9/2841 37/458
4,748,754 A * 6/1988 Schwappach ..... E02F 9/2816 172/713
5,666,748 A 9/1997 Emrich et al.
6,675,509 B2 * 1/2004 Bierwith ..... E02F 9/2825 37/452
8,074,383 B2 * 12/2011 McClanahan ..... E02F 9/2833 37/455
9,315,972 B2 * 4/2016 Anisy ..... E02F 9/2825
9,322,150 B2 * 4/2016 Johnston ..... E02F 9/2825
9,404,240 B2 8/2016 Kunz
9,909,285 B2 * 3/2018 Bjerke ..... E02F 3/40
9,938,695 B2 * 4/2018 Bjerke ..... E02F 9/2808
10,047,504 B2 * 8/2018 Kunz ..... E02F 9/2891
(Continued)

FOREIGN PATENT DOCUMENTS

WO 2011097689 8/2011

*Primary Examiner* — Gary S Hartmann
(74) *Attorney, Agent, or Firm* — Jonathan F. Yates

(57) ABSTRACT

An implement assembly includes an implement having a forward edge and an edge protection system. The edge protection system includes at least one edge shroud having a lower leg that includes a lower end and a lower end inner surface, an upper leg, and a wedge portion, the upper leg including an upper end portion and a connecting portion. The upper end portion has an upper end inner portion that may be angled to the lower end inner surface and/or a horizontal plane extending between the upper leg and the lower leg. The system also includes a boss assembly structured to couple the edge shroud to the implement, and including a pry boss. The angle of the upper end inner surface may be such that a clearance is formed between the upper end inner surface and the pry boss when moving the edge shroud forward in a disengaging direction relative to the implement. The clearance reduces frictional force opposing movement of the edge shroud in the disengaging direction. The pry boss may also include at least one pry notch having a pry surface, the pry notch being structured to receive a free end of a pry tool for prying the pry boss out of the assembly in a pry off direction.

13 Claims, 9 Drawing Sheets

(56) References Cited

U.S. PATENT DOCUMENTS

| | | | | |
|---|---|---|---|---|
| 2004/0216334 | A1 | 11/2004 | Emrich et al. | |
| 2007/0245601 | A1 | 10/2007 | Bearden et al. | |
| 2017/0037603 | A1 | 2/2017 | Kunz | |
| 2017/0058491 | A1 | 3/2017 | Kunz | |
| 2018/0363274 | A1* | 12/2018 | Kunz | E02F 9/2883 |

* cited by examiner

EDGE PROTECTION SYSTEM FOR AN IMPLEMENT

TECHNICAL FIELD

The present disclosure relates generally to implement assemblies having an edge protection system and, more particularly, to edge protection systems having an edge shroud.

BACKGROUND

Earth-moving machines such as excavators, wheel loaders, and track-type tractors and loaders, for example, commonly include an implement structured for digging, cutting, breaking apart, removing, breaking, carrying, or otherwise manipulating material such as rock, soil, sediment, or waste, to name a few examples. These tools are subjected to regular and repeated wear along a forward edge of the implement caused by engagement with the materials. An unprotected forward edge or other part of the implement would not be expected to last more than a few days or weeks in many service environments.

One approach for extending the service life of implements is to protect the forward edge by coupling an edge protection assembly of one or more replaceable wear parts such as teeth and/or edge shrouds. The wear parts may then bear the majority of the abrasion, impact, or other forces that typically cause wear or damage while the implement is in service. All manner, size, and configuration of wear parts and edge protection assemblies are contemplated in the art, but are generally structured for coupling to a particular implement having a forward edge of a particular size and geometry. Of course, wear parts are replaced at regular intervals or otherwise when the parts fail or are no longer acceptable for use. As such, it is desirable to increase the efficiency of servicing edge protection assemblies. Accordingly, strategies that may facilitate disassembly of edge protection assemblies may be desirable.

One such strategy is disclosed in United States Patent Application Publication No. 2017/0037603 to Kunz ("Kunz"). The assembly of Kunz includes a replaceable lug insert structured to detachably couple an edge shroud to a boss mounted on an implement. The lug insert of Kunz is structured for positioning within an opening of the boss, and the edge shroud is structured for positioning on the implement. The lug insert includes a plurality of protrusions structured to register with a plurality of bore holes on the edge shroud. Once the edge shroud is positioned over the boss having the lug insert, a plurality of locks engage the plurality of projections, coupling the edge shroud to the implement. While this and other solutions may facilitate decoupling assemblies from the implements, improved and/or alternative strategies for facilitating removal of assemblies and/or wear parts would be welcomed in the industry.

SUMMARY OF THE INVENTION

In one aspect, an implement assembly includes an implement including a forward edge; an edge shroud coupled to the forward edge, the edge shroud including an upper leg, a lower leg, and a wedge portion connecting the upper leg to the lower leg; and a boss assembly coupling the edge shroud to the implement and including a pry boss positioned between the edge shroud and the implement. The pry boss has an upper side facing the edge shroud, a lower side facing the implement, and a plurality of side surfaces. The upper side of the pry boss has a top surface that includes at least one pry surface structured to engage with a pry tool, the at least one pry surface having an orientation transverse to the top surface and being located peripherally inward of an outer perimeter of the pry boss formed by the plurality of side surfaces.

In another aspect, a method for servicing an implement assembly includes engaging a pry tool against a first pry surface of a pry boss positioned at least partially within an edge shroud coupled to an implement in the implement assembly; prying the pry boss part-way out of the implement assembly with a pry tool engaged against the first pry surface; engaging a pry tool against a second pry surface of the pry boss; prying the pry boss further out of the implement assembly with a pry tool engaged against the second pry surface; and decoupling the edge shroud from the implement.

In still another aspect, an edge protection system for an implement includes an edge shroud including an upper leg, a lower leg, and a wedge portion connecting the upper leg to the lower leg, and the upper leg, the lower leg, and the wedge portion forming an opening for positioning the edge shroud upon a forward edge of an implement; and a pry boss structured for positioning between the edge shroud and the implement, and having an upper side positionable to face the edge shroud, a lower side, and a plurality of side surfaces, the plurality of side surfaces forming an outer perimeter of the pry boss. The upper side of the pry boss has a top surface that includes at least one pry surface structured to engage with a pry tool for prying the pry boss out of the implement, and the at least one pry surface has an orientation transverse to the top surface and is located peripherally inward of the outer perimeter of the pry boss.

DETAILED DESCRIPTION

Figure 1:
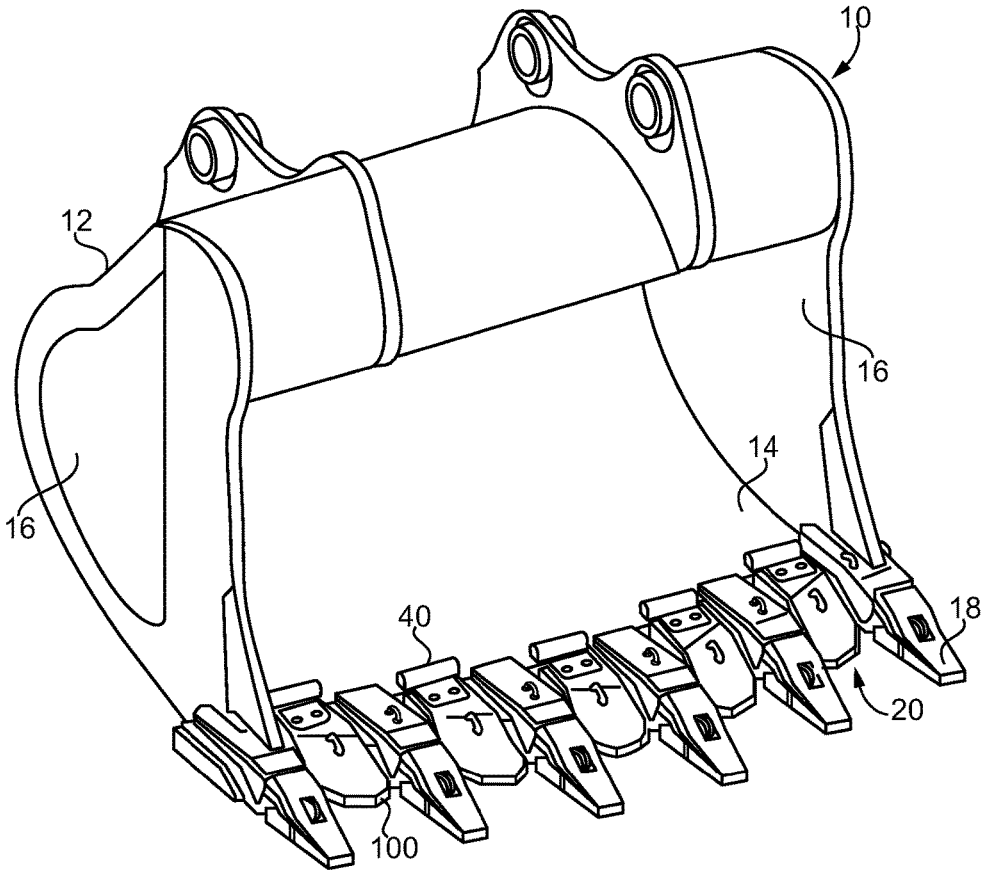
FIG. 1 is a diagrammatic view of an implement assembly, according to one embodiment.

Referring to FIG. 1, a perspective view of an implement assembly 10 according to one embodiment is shown. Implement assembly 10 may include an implement 12 having a first wall or a primary wall 14 disposed between a plurality of side walls 16. Implement 12 may be, for example, a bucket, a blade, or other tool having a ground-engaging or material-engaging edge that is subject to wear while in service. The term "wear" may be understood to include, for example, scratches, scrapes, dents, fractures, cracks, erosion, buckling, fatigue, yield, or the like. Implement 12 may also have an edge protection system (hereinafter "system") 20 that includes at least one and typically a plurality of edge shrouds 100 interspersed with a plurality of teeth 18, and structured to protect and reduce wear of a material-engaging edge and/or section of primary wall 14. Some embodiments of assembly 10 might include different or fewer teeth 18 or perhaps none at all. In some embodiments, edge shrouds 100 may have different shapes and/or sizes among them, and may include different parts or features, or might have parts with different sizes, shapes, and/or relative orientations.

Figure 2:
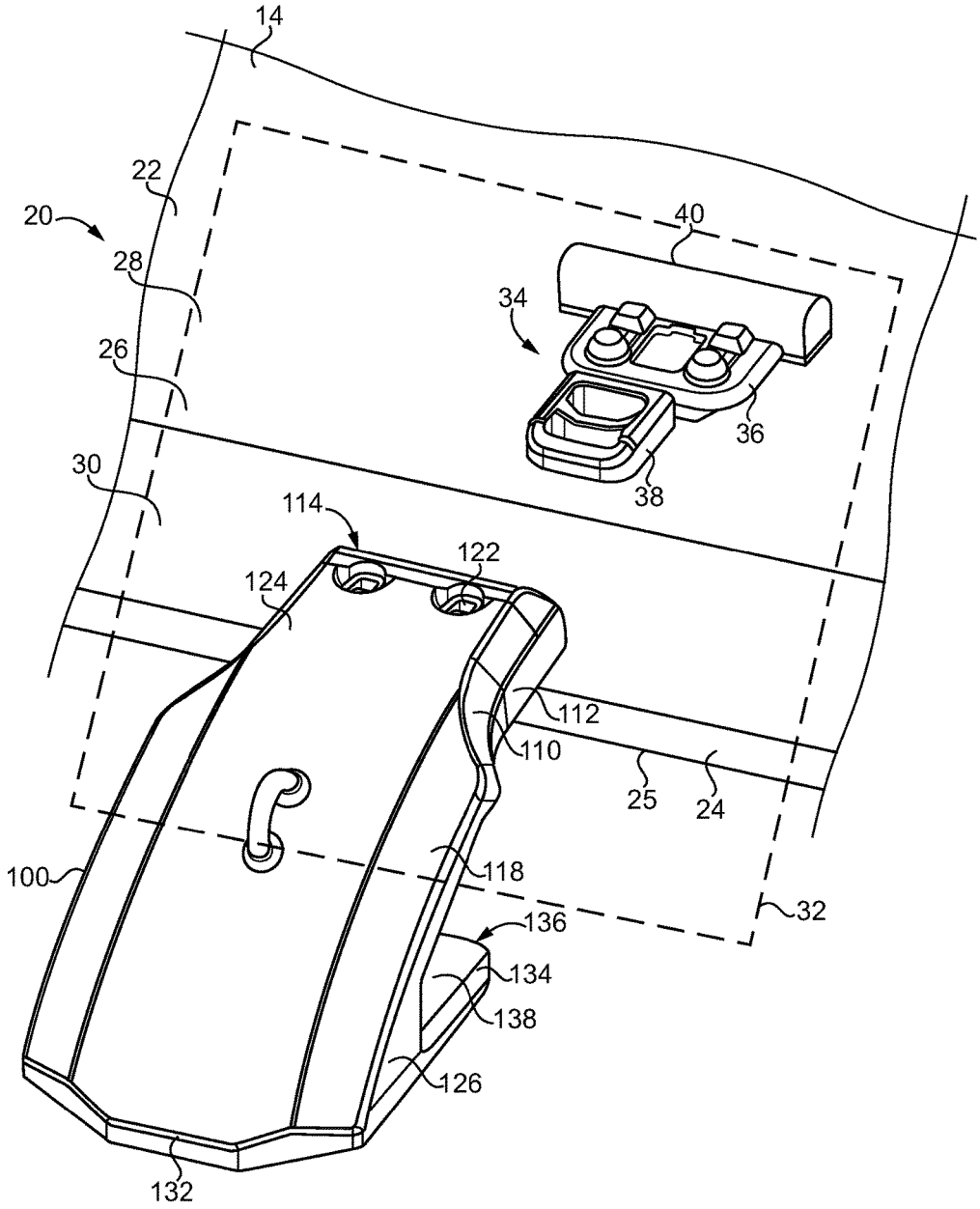
FIG. 2 is a diagrammatic view of an edge protection system, according to one embodiment.
Figure 10:
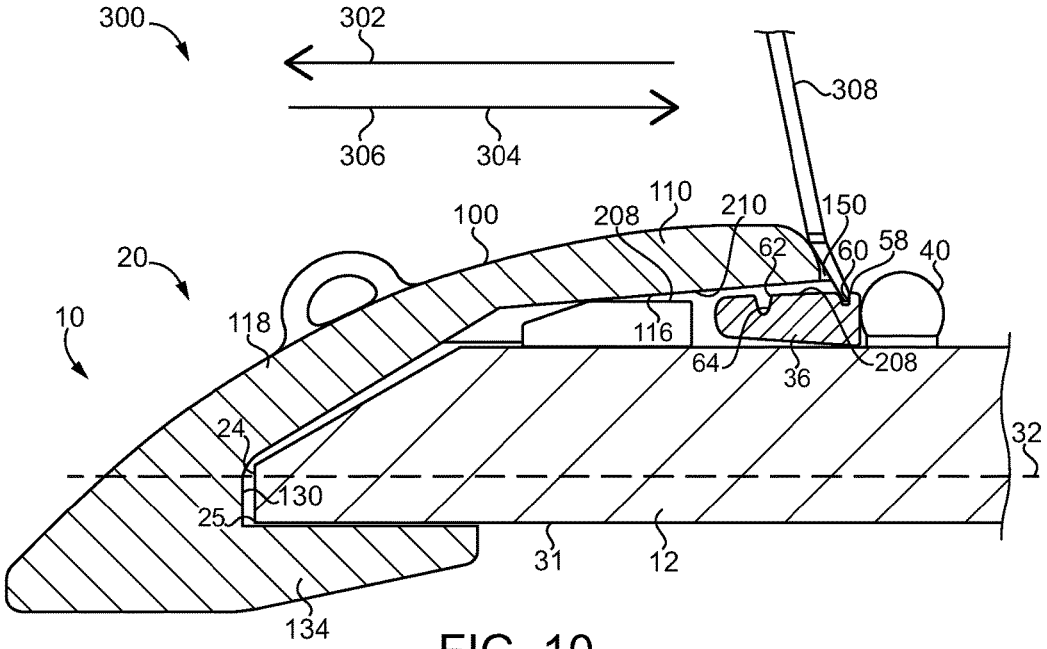
FIG. 10 is a diagrammatic view of an edge protection system at another stage of servicing, according to one embodiment.
Figure 12:
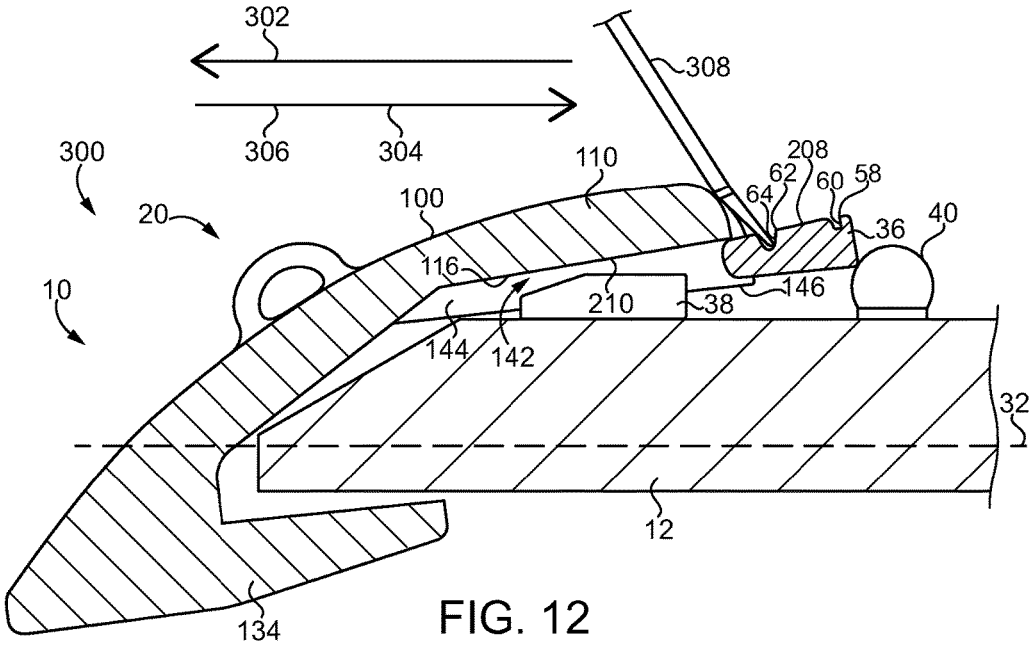
FIG. 12 is a diagrammatic view of an edge protection system at yet another stage of servicing, according to one embodiment.
Figure 13:
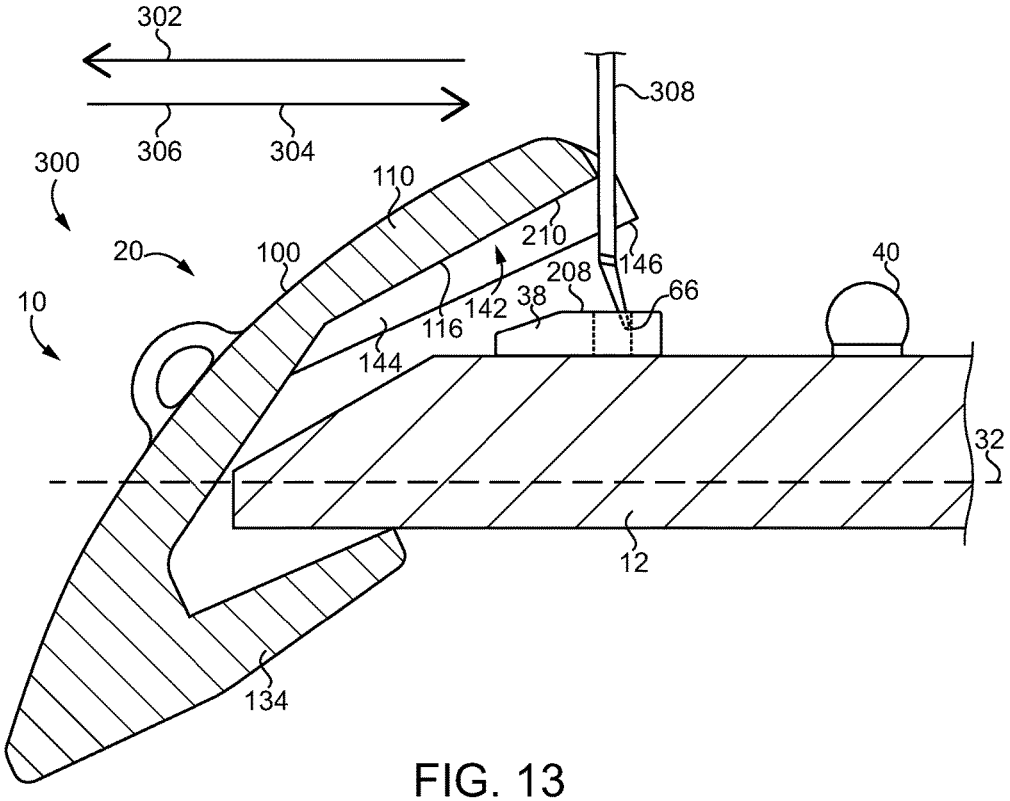
FIG. 13 is a diagrammatic view of an edge protection system at yet another stage of servicing, according to one embodiment.

Referring now also to FIG. 2, a perspective view of system 20 is shown. Primary wall 14 may have an edge portion 22 extending to a ground-engaging edge 24, wherein ground-engaging edge 24 includes a forward edge 24. Edge portion 22 includes an edge surface 26 that may have a coupling surface 28 and an angled surface 30, wherein coupling surface 30 is positioned between coupling surface 28 and forward edge 24. Coupling surface 30 and angled surface 28 may be substantially planar, with angled surface 28 angled downwardly relative to coupling surface 30, although the present disclosure is not thereby limited. Coupling surface 30 may be substantially parallel to a bottom surface 31 (as shown in FIGS. 10, 12, and 13 discussed hereinafter) of implement 12. In other embodiments, coupling surface 30, angled surface 28, and bottom surface 31 may have different relative orientations. For example, angled surface 28 and coupling surface 30 may be substantially parallel, with each being angled to the bottom surface. System 20 may also include a boss assembly 34 structured to couple edge shroud 100 to implement 12. Boss assembly 34 may include a floating boss 36, which may include a pry boss (hereinafter "pry boss 36"), positioned between edge shroud 100 and implement 12, and a fixed boss 38, which may include a mounted boss (hereinafter "mounted boss 38"), attached to implement 12 forward of pry boss 36, such as by welding or bolting. Pry boss 36 may be structured for coupling to edge shroud 100 and mounted boss 38 may be attached to edge portion 22. In other embodiments, assembly 10 might not have boss assembly 34, with edge shroud 100 being coupled directly to implement 12, or may have a boss assembly having a different number or configuration of bosses.

Figure 3:
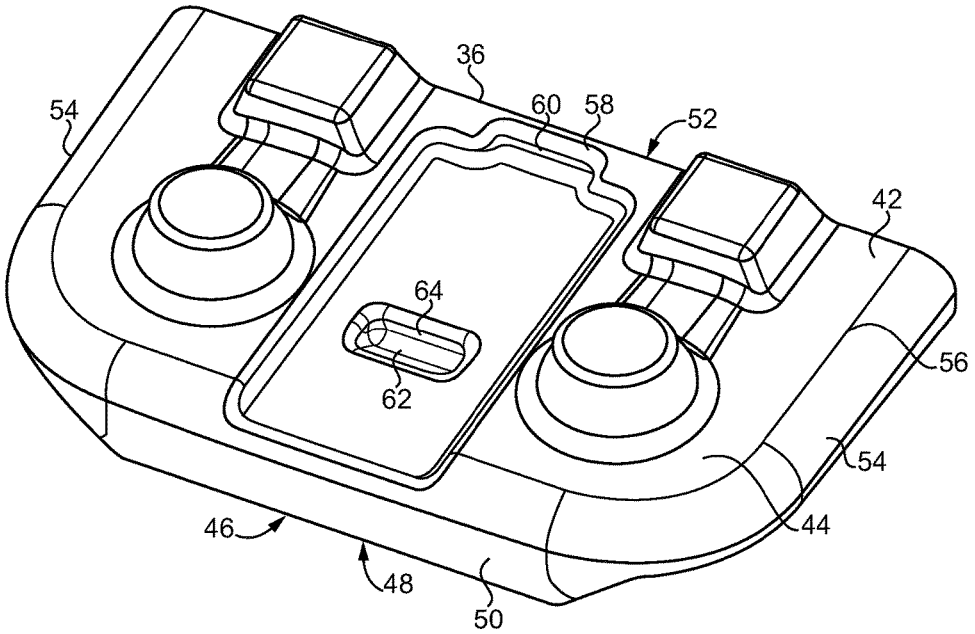
FIG. 3 is a diagrammatic view of a boss, according to one embodiment.

Referring now also to FIG. 3, an enlarged perspective view of pry boss 36 is shown according to one embodiment. Pry boss 36 may include an upper side 42 positionable to face edge shroud 100 and a lower side 46 (as shown in FIGS. 7 and 9-13, discussed hereinafter) positionable to face implement 12. Upper side 42 may include a top surface 44, and lower side 46 may include an edge engaging surface 48 (as shown in FIGS. 7 and 9-13, discussed hereinafter). As used herein, the terms "top" and "lower," "front" and "back," "forward" and "backward," and the like are used in a relative sense, each in relation to the others when the assembly, device, or system being discussed is generally viewed in a configuration suitable for service, and should not necessarily be taken to mean that the structures discussed herein have a particular orientation.

Pry boss 36 may also have a plurality of side surfaces 54, including a front surface 50 and a back surface 52 (as shown in FIGS. 10-13, discussed hereinafter), forming an outer perimeter 56 around pry boss 36. Top surface 44 may include one or more pry surfaces structured to engage an end of a pry tool, so as to allow a service technician to apply a pry force on pry boss 36. Top surface 44 may have a first pry surface 60 positioned within a first pry notch 58, and a second pry surface 64 positioned within a second pry notch 62. First and second pry notches 58, 62 may be formed within top surface 44. Pry surfaces 60, 64 may have an orientation transverse to top surface 44 and may be located peripherally inward of outer perimeter 56. As used herein, a transverse orientation contemplates a perpendicular orientation or a diagonal orientation. In other embodiments, the pry surfaces, including pry surfaces 60, 64, may have any other structure that allows for engagement with a pry tool. Second pry notch 62 may be positioned forward of first pry notch 58. In some embodiments, other structures of assembly 10, such as implement 10 and/or edge shroud 100 may include one or more pry surfaces. Referring again to FIG. 2, mounted boss 38 may have a plurality of side surfaces 41, a top surface 39, and a pry surface 66 structured to engage the free end of a pry tool. System 20 may also include a shroud deflector 40 attached to implement 12 rearward of pry boss 36. In some embodiments, system 20 might not include shroud deflector 40, or might include a different type of shroud deflector, including a shroud deflector formed integrally with the subject implement, or still another variation such as a bolt-on shroud deflector used only for servicing might be used.

Figure 4:
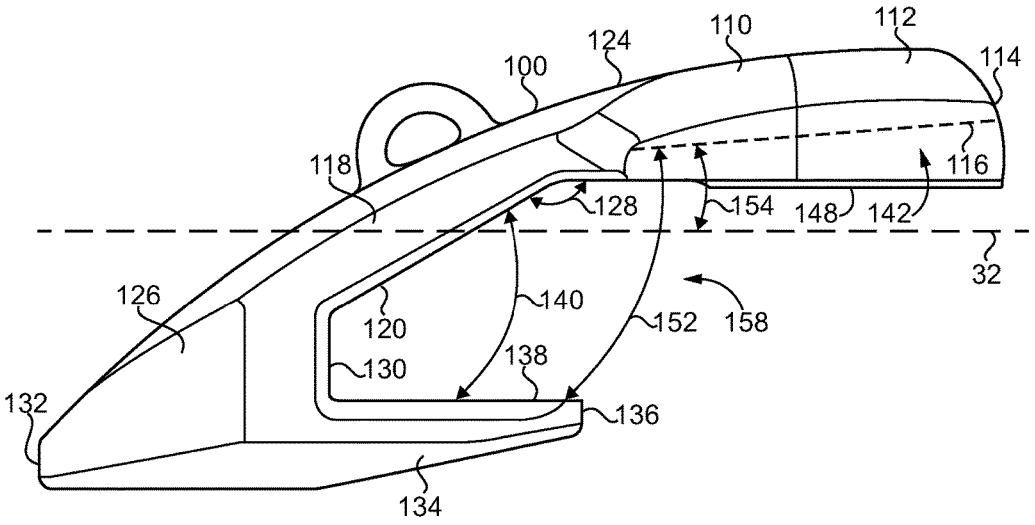
FIG. 4 is a diagrammatic view of an edge shroud in a first orientation, according to one embodiment.
Figure 5:
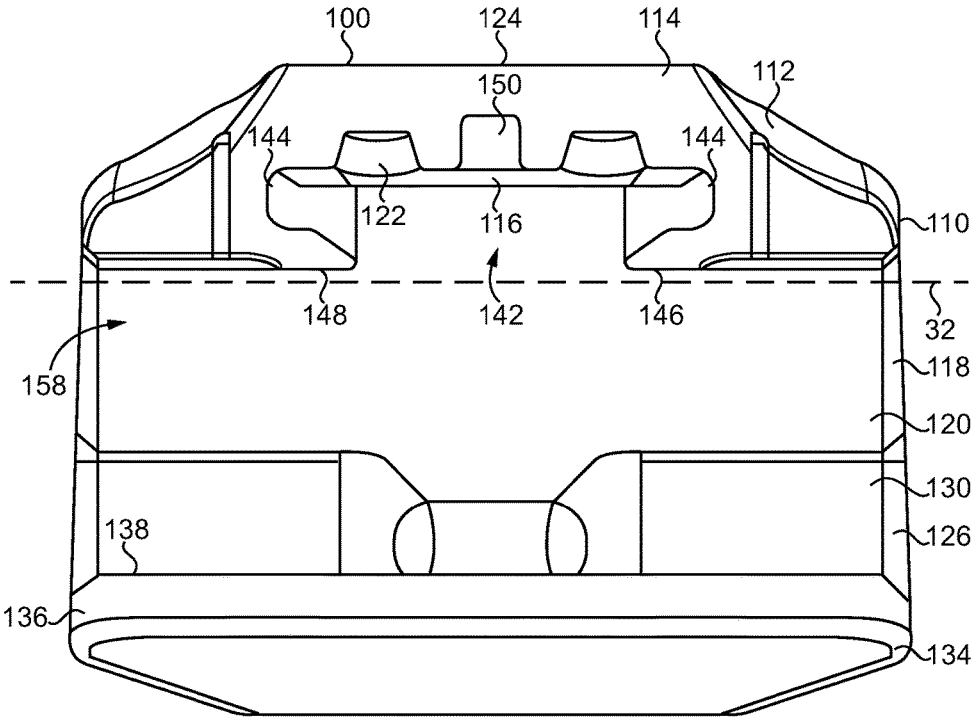
FIG. 5 is a diagrammatic view of an edge shroud in a second orientation, according to one embodiment.
Figure 6:
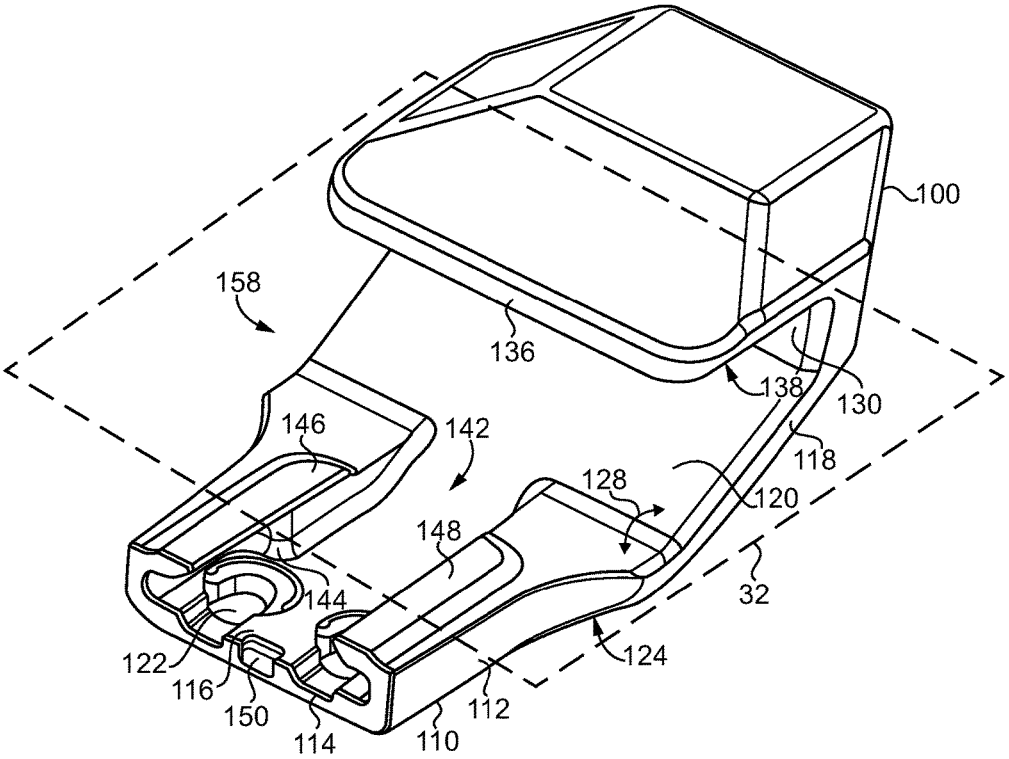
FIG. 6 is a diagrammatic view of an edge shroud in a third orientation, according to one embodiment.

Referring now also to FIGS. 4-6, different views of edge shroud 100 are shown according to one embodiment. Edge shroud 100 may include a wedge portion 126 attaching an upper leg 110 to a lower leg 134, which may have a lower end 136 and a lower end inner surface 138 extending forward from lower end 136. Lower end inner surface 138 may be parallel to a horizontal plane 32 extending between upper leg 110 and lower leg 134. Wedge portion 126 may include a wedge inner surface 130 and a forward projecting nose 132. Upper leg 110 may include an upper end portion 112 and a connecting portion 118 extending between upper end portion 112 and wedge portion 126. Upper leg 110 may project more rearwardly than lower leg 134 such that a majority of upper end portion 112 is rearward of a lower end 136 of lower leg 134. Upper end portion 112 may also include an upper end 114, which may have a pry tool cutout 150 formed therein and structured to receive the end of a pry tool. Upper end portion 112 may also include an upper end inner surface 116 extending forward from upper end 114, and connecting portion 118 may include a connecting portion inner surface 120. Upper end inner surface 116 may be inclined to connecting portion inner surface 120 at a first angle 128, and connecting portion inner surface 120 may be inclined to lower end inner surface 138 at a second angle 140. As illustrated in FIG. 4, first angle 128 may be larger than second angle 140. Upper end inner surface 116, connecting portion inner surface 120, wedge inner surface 130, and lower end inner surface 138 may form an opening 158 for fitting edge shroud 100 on forward edge 24 of implement 12. Upper leg 110 may have an upper outside surface 124 that is curved between upper end 114 and forward projecting nose 132, and may have at least one bore 122 extending between upper outside surface 124 and upper end inner surface 116. Bore 122 is structured to receive a fastener for coupling edge shroud 100 to boss assembly 34 or edge portion 22.

Upper end portion 112 may further include a first implement-engaging surface 146, a second implement-engaging surface 148, and a channel 142 structured to receive pry boss 36. Channel 142 may be formed of upper end inner surface 116 and a plurality of side walls 144 extending between upper end inner surface 116 and one of first or second implement-engaging surfaces 146, 148. In the present embodiment, implement-engaging surface 146, 148 may be substantially planar and positioned upon opposite sides of upper end inner surface 116. Implement engaging surfaces 146, 148, together with lower end inner surface 138, upper end inner surface 116, wedge inner surface 130, and connecting portion inner surface 120 form opening 158. Implement engaging surfaces 146, 148 may also be substantially parallel to horizontal plane 32, and structured to face coupling surface 28, which may be parallel to horizontal plane 32. Lower end inner surface 138, wedge inner surface 130, connecting portion inner surface 120, and implement-engaging surfaces 146, 148 of edge shroud 100 may be oriented relative to each other so as to be substantially parallel to bottom surface 31, forward edge 24, angled surface 30, and coupling surface 28 of implement 12, respectively, so that edge shroud 100 may be fitted upon implement 12. For example, wedge inner surface 130 may have a substantially vertical orientation and may be substantially perpendicular to lower end inner surface 138 so as to face an orthogonal lower part 25 of forward edge 24. In some embodiments, edge shroud surfaces 120, 130, 138, 146, 148 may have different relative orientations configured to correspond with the relative orientations of implement surfaces 30, 24, 31, 28, respectively.

One or more parts of system 20, including edge shroud 100 or pry boss 36, may be structured to facilitate disassembly. For instance, upper end inner surface 116 of edge shroud 100 may be inclined to lower end inner surface 138 at a third angle 152, such that upper end inner surface 116 slopes downwardly towards forward projecting nose 132 to form a draft for assisting in disengagement of edge shroud 100 from implement 12. It has been discovered that a draft, taper, slope, or other angled surface makes it easier for a service technician to remove edge shroud 100 from implement 12 for reasons that will become apparent from the discussion herein. Third angle 152 may be less than about 10 degrees. As used herein, the term "about" can be understood in the context of conventional rounding to a consistent number of significant digits. For example, "about 10 degrees" means from 5 degrees to 14 degrees, "about 14 degrees" means from 13.4 degrees to 14.5 degrees, and so on. In some embodiments, third angle 152 may be from about 2 degrees to about 4 degrees. Upper end inner surface 116 may be oriented at a range of angles relative to lower end inner surface 138 and/or to horizontal plane 32 to facilitate disassembly of assembly 10 in accordance with the present disclosure. In some embodiments, upper end inner surface 116 could be three-dimensional or have a left to right diagonal slope, for instance.

Figure 7:
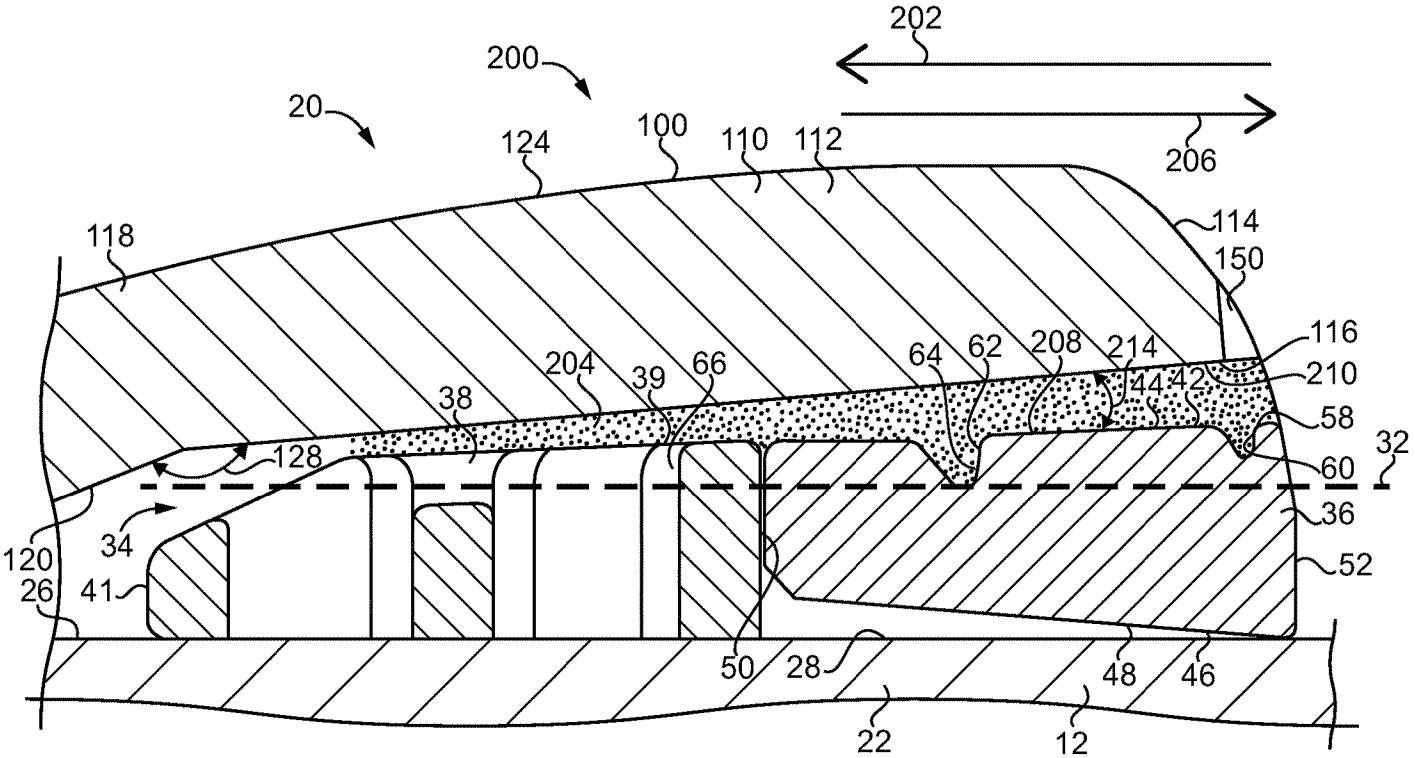
FIG. 7 is a sectioned side diagrammatic view of an edge protection system, according to one embodiment.
Figure 8:
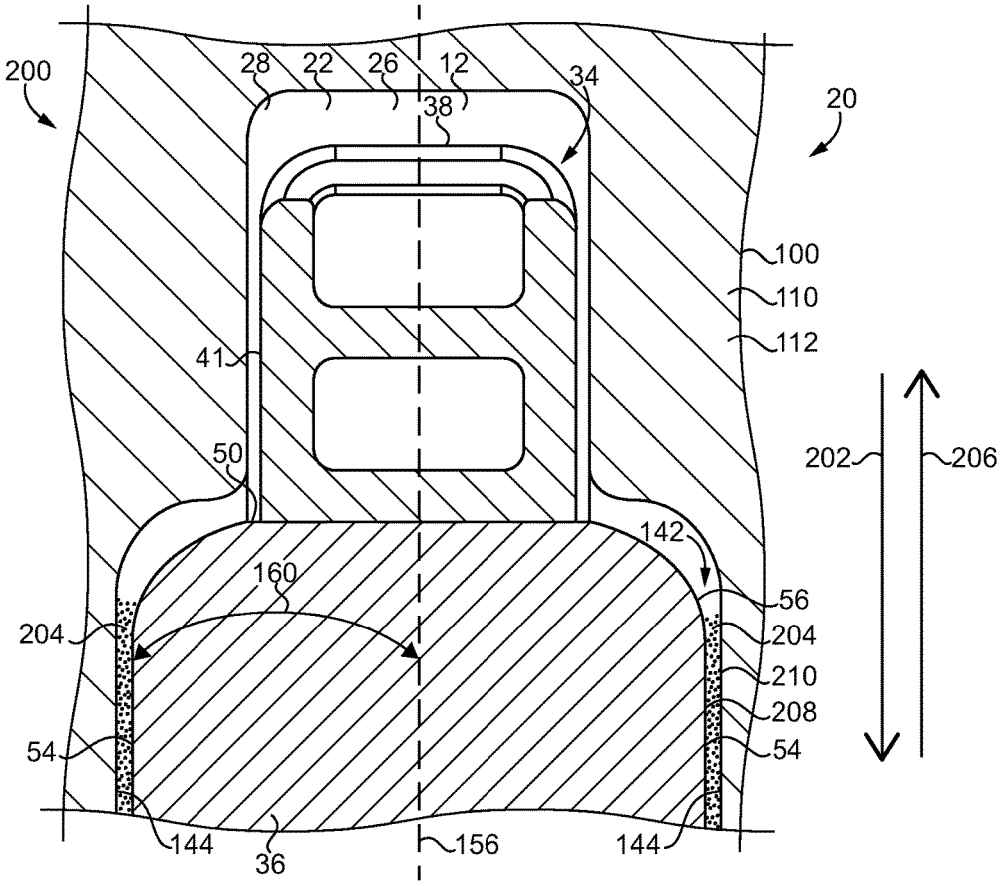
FIG. 8 is a sectioned top diagrammatic view of an edge protection system, according to one embodiment.

Pry boss 36 may be positioned such that first pry notch 58 is in register with pry tool cutout 150 in upper end 114, so as to allow the free end of a pry tool to access first pry surface 60 when edge shroud 100 is coupled to implement 12. Referring now also to FIG. 7, a cross-sectional view of system 20 is shown according to one embodiment. Upper end inner surface 116 may be inclined to horizontal plane 32 at a fourth angle 154, which may be about 10 degrees or less. In some embodiments, fourth angle 154 may be from about 2 degrees to about 4 degrees. As illustrated in FIG. 7, lower end inner surface 138 may be parallel to horizontal plane 32 such that third angle 152 and fourth angle 154 are identical. Coupling surface 28 may also be parallel to horizontal plane 32 in certain embodiments. Referring now also to FIG. 8, a cross-sectional view of system 20 is shown according to one embodiment. One or more of side walls 144 of channel 142 may be angled to a vertical plane 156 laterally bisecting edge shroud 100 so as to form a fifth angle 160 that opens in a rearward direction. Fifth angle 160 may be about 2 degrees or less, however, in some embodiments, fifth angle 160 may be from about 1 degree to about 2 degrees.

Boss assembly 34 may also be structured to facilitate disassembly. For instance, at least one of top surface 44, which may face edge shroud 100, and edge-engaging surface 48, which may face implement 12, may have a sloped profile between front surface 50 and back surface 52. In some embodiments, at least one of surfaces 44, 48 may be sloped to upper end inner surface 116 and/or coupling surface 22, respectively. In still other embodiments, at least one of surfaces 44, 48 may be sloped to horizontal plane 32. At least one of the plurality of side surface may also be angled to vertical plane 156 so as to form an angle opening in a rearward direction.

These principles and the disclosed geometry can also be seen in other embodiments of system 20 and assembly 10 according to the present disclosure. It should thus be appreciated that the description herein of any single one of the embodiments of the present disclosure can be taken to apply to any other of the embodiments of the present disclosure except where indicated otherwise or apparent from the context.

INDUSTRIAL APPLICABILITY

The present disclosure is applicable to a great variety of implements having a forward edge, such as buckets or blades used in connection with hydraulic excavators, wheel loaders, front shovel draglines, and tractors, for instance. Generally, the present disclosure may facilitate disassembly of assembly 10, and, more particularly, it may facilitate removal of edge shroud 100 from implement 12. Each edge shroud 100 may function as a wear part, and may be periodically replaced when worn or misshapen beyond a desired or effective degree. When servicing assembly 10, a service technician might apply a force in a forward disengaging direction 202 (hereinafter a "disengaging force"), so as to urge edge shroud 100 forward relative to implement 12 and substantially parallel to horizontal plane 32. Disengaging direction 202 may be identical to a pull-off direction, which is the direction that a service technician removes edge shroud 100 from implement 12.

It has been observed that material that gets packed into interfacing surfaces of assembly 10 may make it difficult to remove edge shrouds 100 from implement 12. This packed material 204 may therefore result in greater downtime for machines that employ such implements, and may increase costs, such as labor costs, associated with servicing the implements. As will be appreciated from the description herein, the present disclosure provides various advantages over prior assemblies, devices, and systems, and respecting removal of edge shrouds 100 from an implement.

Referring now again to FIGS. 7 and 8, packed material 204 is shown lodged between a mounting surface 208 of implement 12 and an inner surface 210 of edge shroud 100. Inner surface 210 may include upper end inner surface 116, and mounting surface 208 may include top surface 44. In some embodiments, inner surface 210 may be another surface located upon upper leg 110 that faces the surface of another structure of system 20, such as implement 12 or bosses 36, 38. For instance, inner surface 210 may include side walls 144 of channel 142. In some embodiments, mounting surface 208 may include surfaces of system 20 that face inner surfaces 210 of edge shroud 100. For example, mounting surface 208 may include a surface of at least one of pry boss 36 or mounted boss 38 positioned between edge surface 26 and edge shroud 100, such as surfaces 44, 54 of pry boss 36, and surfaces 39, 41 of mounted boss 38. In some embodiments, mounting surface 208 may include edge surface 26. It has further been observed that packed material 204 may create disengagement-resisting forces 206, including frictional force (hereinafter "frictional force 206"), that oppose movement of edge shroud 100 in disengaging direction 202 relative to implement 12. Frictional force can make removal of edge shroud 100 from implement 12 difficult, requiring service technicians to use sledge hammers or the like to apply a disengaging force of sufficient magnitude to disengage edge shroud 100. Use of sledge hammers or the like to disengage edge shroud 100 is known to have certain disadvantages, however. For instance, use of sledge hammers or the like may damage implement 12 or other non-wear parts of assembly 10, or be fatiguing to the technician. As such, systems and methods facilitating disassembly of assembly 10 that reduce the disengaging force needed to remove edge shroud 100 and/or employ a more elegant tool than a sledge hammer or the like, are desirable.

It has been discovered that reducing surface area of contact and/or the relative extent or force of packing between packed material 204 and surfaces 208, 210 may reduce frictional forces 206 opposing sliding edge shroud 100 off implement 12, which facilitates servicing of assembly 10, reduces downtime, and have other advantages that will be appreciated from the disclosure herein. Referring still to FIGS. 7 and 8, devices and systems for reducing frictional force 206 opposing movement of edge shroud 100 in disengaging direction 202 relative to implement 12 are shown. System 20 of the present embodiment may include a disengagement system 200 that may have an interface 211 formed of mounting surface 208 and inner surface 210. At least one of surfaces 208, 210 may be sloped to form an angle 214 between mounting surface 208 and inner surface 210 so as to limit disengaging-resisting forces, including frictional force 206, that may be caused by packed material 204 lodged between surfaces 208, 210. Angle 214 may be less than about 5 degrees. In some embodiments, angle 214 may be from about 2 degrees to about 4 degrees. In some embodiments, angle 214 may be identical to third angle 152 and/or fourth angle 154. Disengaging system 200 may make it easier for a service technician to remove edge shroud 100 from implement 12.

Figure 9:
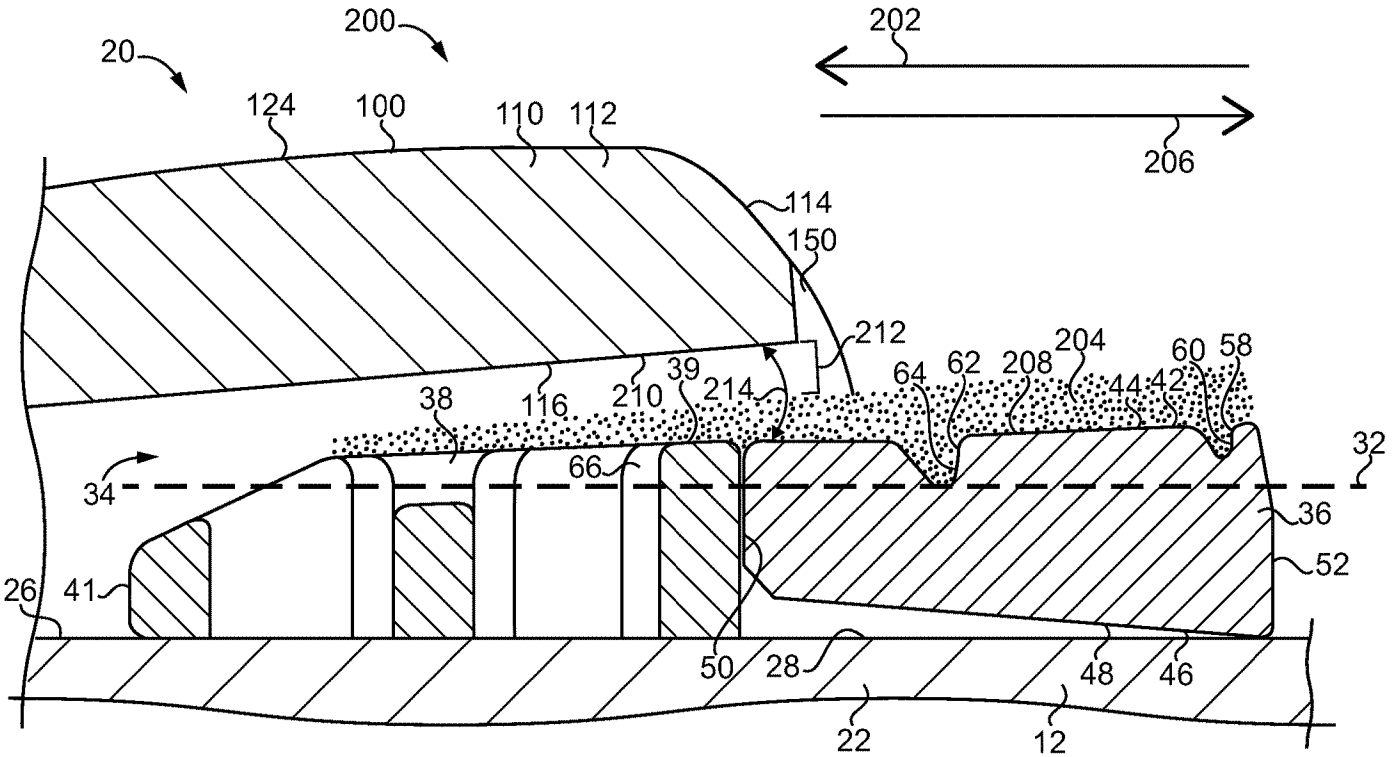
FIG. 9 is a diagrammatic view of an edge protection system at one stage of servicing, according to one embodiment.

Referring now also to FIG. 9, a cross-sectional view of disengagement system 200 is shown after edge shroud 100 has been slid in disengaging direction 202 relative to packed material 204 in response to application of a disengaging force. Sliding of edge shroud 100 may include forwardly moving upper leg 110, lower leg 134, and wedge portion 126 in disengaging direction 202 relative to implement 12. Angle 214 may cause a clearance 212 to be formed at interface 211 between inner surface 210 and mounting surface 208. Pulling edge shroud 100 forward relative to implement 100 and parallel to horizontal plane 32 may cause surfaces 208, 210 to move divergent to each other such that a gap is formed between the surfaces or otherwise widens to form clearance 212 as edge shroud 100 is pulled forward. In some embodiments, there may be a gap between surfaces 208, 210 before edge shroud 100 is moved, and pulling edge shroud 100 in disengaging direction 202 may widen the gap, forming clearance 212 or increasing its size. A service technician may continue to slide edge shroud 100 relative to packed material 204 within clearance 212, which may be adjacent to inner surface 210 of edge shroud 100. In some embodiments, packed material 204 within clearance 212 may be adjacent to mounting surface 208. Continuing to slide edge shroud 100 forward in disengaging direction 202 may increase the size of clearance 212 such that frictional force 206 between packed material 204 and at least one of surfaces 208, 210 may be further reduced. Forming clearance 212 reduces surface area contact between packed material 204 and at least one of surfaces 208, 204, which reduces frictional forces 206 opposing sliding of edge shroud 100 forward relative to implement 12. It has been discovered that packed material 204 lodged between surfaces 208, 210 may also increase frictional forces 206 elsewhere in assembly 10, such as between lower leg inner surface 138 and bottom surface 31.

Referring now also to FIGS. 10-13, cross-sectional and partial cross-sectional views of a disengagement system 300 are shown according to one embodiment. Disengagement system 300 may include edge shroud 100 and boss assembly 34 having pry boss 36 and mounted boss 38, and may be structured to reduce disengagement-resisting forces 306 that may oppose sliding edge shroud 100 relative to implement 12 in a disengaging direction 302. Disengagement-resisting forces 306 includes frictional force (hereinafter "frictional force 306"). Disengaging direction 302 and frictional force 306 may be identical to disengaging direction 202 and frictional force 306, respectively. It should be appreciated while certain embodiments of the present disclosure may include disengagement system 200 and disengagement system 300, other embodiments may use only one of disengagement systems 200, 300, or elements thereof.

Figure 11:
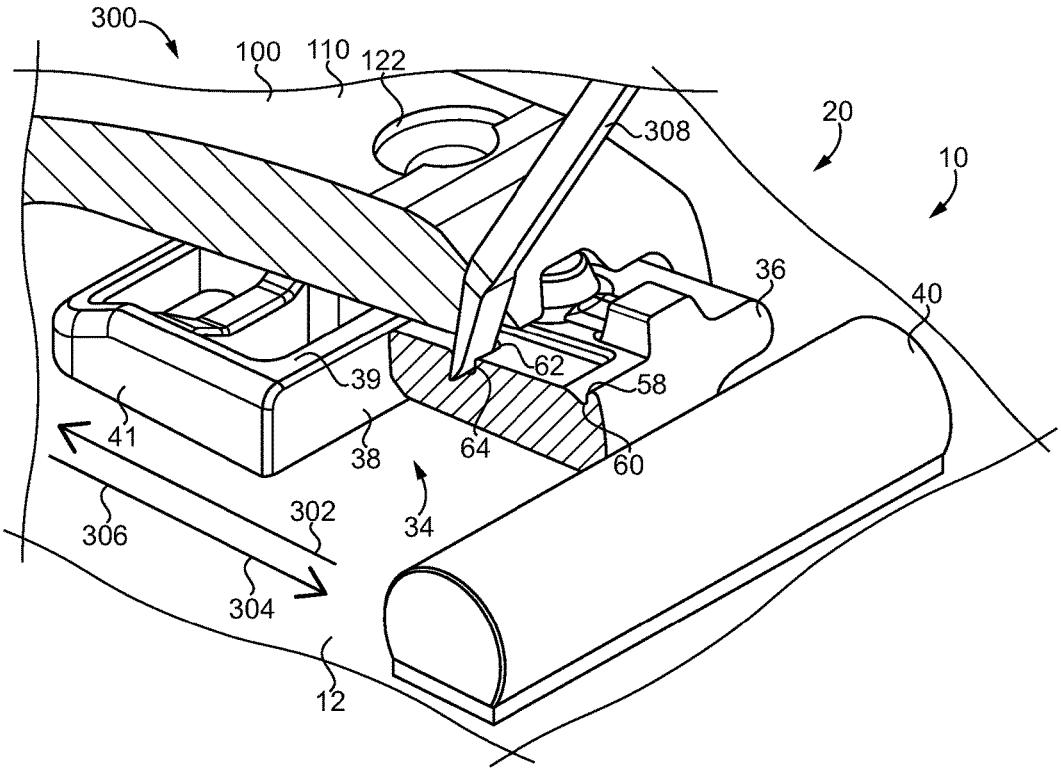
FIG. 11 is a diagrammatic view of an edge protection system at another stage of servicing, according to one embodiment.

Disengagement system 300 may facilitate disassembly by enabling removal of edge shroud 100 from implement 12 using a pry tool 308 instead of a sledge hammer or the like, or other dramatic strategies. More particularly, disengagement system 300 may be configured to allow for removal of pry boss 36 to facilitate disassembly. FIG. 10 shows a cross section of disengagement system 300 including pry tool 308. As illustrated in FIG. 10, a service technician may engage pry tool 308 against first pry surface 60 of pry boss 36 positioned at least partially within edge shroud 100, wherein pry boss 36 may at least partially couple edge shroud 100 to implement 12. With pry tool 308 engaged against first pry surface 60, the service technician may pry pry boss 36 part-way out of assembly 100, in a pry-off direction 304 opposite disengaging direction 302. Further prying may be necessary to remove pry boss 36 from implement 12. In some embodiments, prying pry boss 36 in this manner may disengage pry boss 36 in such a way that pry boss 36 may be removed by the service technician without further use of pry tool 308. As shown in FIG. 11, partially prying pry boss 36 out of assembly 10 may provide access to second pry notch 62 forward of first pry notch 58, and having second pry surface 64. The service technician may then engage pry tool 308 against second pry surface 64 and pry pry boss 36 further out of assembly 10 with pry tool 308 engaged against second pry surface 64. The service technician may then remove pry boss 36 from assembly 10 and decouple edge shroud 100 from implement 12. In some embodiments, pry boss 26 may include a third pry notch forward of second pry notch 62 and which has a third pry surface, a fourth pry notch forward of the third pry notch and which has a fourth pry surface, and so on, which may allow the service technician to continue engaging pry tool 308 with pry surfaces to pry boss 36 further out of assembly 10 until pry boss 36 is removed.

Engaging pry tool 308 with pry surfaces 60, 64 may include inserting the free end of pry tool 308 into first and second pry notches 58, 62, respectively. In some embodiments, multiple pry tools 308 may be used, or pry tool 308 and another tool may be used.

Once pry boss 36 is removed from assembly 10, the service technician may decouple edge shroud 100 from implement 12. As shown in FIG. 12, motion of pry boss 36 in pry-off direction 304 during prying may be stopped by shroud deflector 40, which may have a fixed position on implement 12 rearward of boss assembly 34. Once motion of pry boss 36 is stopped in pry-off direction 304, the service technician may continue to apply a prying force, which may cause edge shroud 100 to slide forward in disengaging direction 302 relative to implement 10 and in response to the stopping of the motion of pry boss 36. In this way, prying of pry boss 36 may also cause edge shroud 100 to be pushed in disengaging direction 302. In some embodiments, edge shroud 100 may be removable from implement 12 once pry boss 36 has been freed of assembly 12. System 300 may also have mounted boss 38, which may have pry surface 66, as illustrated in FIG. 13. Once pry boss 36 has been removed from assembly 10, the service technician may be able to remove edge shroud 100 from implement 12 by engaging pry tool 308 against pry surface 66 and then prying edge shroud 100 off implement 12 in disengaging direction 302. In some embodiments, the service technician may engage pry tool 308 against another pry surface, for instance, on implement 10 or edge shroud 100, and then pry edge shroud 100 off implement 10.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. It will be appreciated that certain features and/or properties of the present disclosure, such as relative dimensions or angles, may not be shown to scale. As noted above, the teachings set forth herein are applicable to a variety of different implements having a variety of different structures than those specifically described herein. Other aspects, features and advantages will be apparent upon an examination of the attached drawings and appended claims. As used herein, the articles "a" and "an" are intended to include one or more items, and may be used interchangeably with "at least one." Where only one item is intended, the term "one" or similar language is used. Also, as used herein, the terms "has," "have," "having," or the like are intended to be open-ended terms.

What is claimed is:

1. An implement assembly comprising:

an implement including a forward edge;

an edge shroud coupled to the forward edge, the edge shroud including an upper leg, a lower leg, and a wedge portion connecting the upper leg to the lower leg; and a boss assembly coupling the edge shroud to the implement and including a pry boss positioned between the edge shroud and the implement;

the pry boss having an upper side facing the edge shroud, a lower side facing the implement, and a plurality of side surfaces; and the upper side of the pry boss having a top surface that includes at least one pry surface structured to engage with a pry tool, the at least one pry surface having an orientation transverse to the top surface and being located peripherally inward of an outer perimeter of the pry boss formed by the plurality of side surfaces.

2. The assembly of claim 1 wherein the upper leg includes an upper end having a pry tool cutout formed therein, and the pry tool cutout being in register with the at least one pry surface.

3. The assembly of claim 2 wherein the top surface has a pry notch formed therein, and the at least one pry surface includes a pry surface within the pry notch.

4. The assembly of claim 3 wherein the top surface has a second pry notch formed therein, and the at least one pry surface includes a second pry surface within the second pry notch.

5. The assembly of claim 4 wherein the second pry notch is positioned forward of the first pry notch.

6. The assembly of claim 2 wherein the upper leg includes a channel formed therein and being in register with the at least one pry surface.

7. The assembly of claim 1 wherein the pry boss includes a floating boss, and the boss assembly further includes a fixed boss attached to the implement forward of the pry boss and includes another pry surface.

8. The assembly of claim 1 further including a shroud deflector attached to the implement rearward of the pry boss.

9. The assembly of claim 1 wherein the plurality of side surfaces includes a front surface and a back surface, and at least one of the upper side or the lower side has a sloped profile between the front surface and the back surface.

10. The assembly of claim 1 wherein at least one of the plurality of side surfaces is angled to a vertical plane bisecting the pry boss so as to form an angle opening in a rearward direction.

11. An edge protection system for an implement comprising:

an edge shroud including an upper leg, a lower leg, and a wedge portion connecting the upper leg to the lower leg, and the upper leg, the lower leg, and the wedge portion forming an opening for positioning the edge shroud upon a forward edge of an implement; and a pry boss structured for positioning between the edge shroud and the implement, and having an upper side positionable to face the edge shroud, a lower side, and a plurality of side surfaces, the plurality of side surfaces forming an outer perimeter of the pry boss;

the upper side of the pry boss having a top surface that includes at least one pry surface structured to engage with a pry tool for prying the pry boss out of the implement; and the at least one pry surface having an orientation transverse to the top surface and being located peripherally inward of the outer perimeter of the pry boss.

12. The system of claim 11 wherein the at least one pry surface is positioned within a pry notch, and wherein the top surface further includes a second pry surface within a second pry notch.

13. The system of claim 11 wherein the edge shroud includes a pry tool cutout formed therein and in register with the at least one pry surface.

* * * * *